US006052845A

United States Patent [19]

Harvey

[11] Patent Number: 6,052,845

[45] Date of Patent: Apr. 25, 2000

[54] CULTURED MARBLE SHOWER SEAT AND METHODS USING THE SAME

[76] Inventor: Brian Harvey, 17490 Meandering Way, Suite 106, Dallas, Tex. 75252

[21] Appl. No.: 09/226,385

[22] Filed: Jan. 6, 1999

[51] Int. Cl.[7] ..... A47K 3/12

[52] U.S. Cl. ..... 4/611; 4/612; 4/614; 52/344

[58] Field of Search ..... 4/559, 571.1, 573.1, 4/578.1, 605, 611, 612, 614; 248/220.1; 52/385, 389, 390, 344; 108/42

[56] References Cited

U.S. PATENT DOCUMENTS

| | | | |
|---|---|---|---|
| D. 360,023 | 7/1995 | Hunger et al. | D23/304 |
| D. 395,135 | 6/1998 | Joss | D23/304 |
| 3,640,041 | 2/1972 | Michieli | 4/578.1 X |
| 4,708,310 | 11/1987 | Smith | 248/220.1 |
| 5,340,070 | 8/1994 | Soma | 248/220.1 |
| 5,542,218 | 8/1996 | Rompel | 52/34 |
| 5,732,421 | 3/1998 | Scherberger | 4/611 |

*Primary Examiner*—Robert M. Fetsuga
*Attorney, Agent, or Firm*—Smith & Danamraj, P.C.

[57] ABSTRACT

An apparatus to be used in a shower stall, comprising a single pour cultured marble slab 10 whereby the slab is placed horizontally and is shaped such that four edges 11A, 11B, 12A and 12B will fit into the corner of and will be supported by the walls of the shower stall.

5 Claims, 3 Drawing Sheets

CULTURED MARBLE SHOWER SEAT AND METHODS USING THE SAME

BACKGROUND OF THE INVENTION

1. Field of the Invention

The present invention relates in general to seats and shelves used in bathrooms and shower stalls, and in particular to cultured marble shower seats.

2. Background—Description of Related Art

Shower seats and shelves have been installed in shower stalls for many years. Shower seats are especially popular among women who use them when they shave their legs. Furthermore, some physically challenged people find that shower seats are a necessity.

Shower seats are constructed out of a variety of material. Portable plastic seats are often used. While functional, plastic shower seats have significant aesthetic drawbacks. They often create the impression of a hospital or nursing home retrofit. For aesthetic reasons, shower seats are often constructed of the same material as the shower stall walls. For instance, single-piece fiberglass shower stalls often have shower seats and shelves molded into them. Shower stalls lined with ceramic tile often have shower seats constructed of a wood or brick frame lined with tile matching that used on the walls. Similarly, stalls lined with marble tile often have shower seats built up from bricks. The marble tiles are then attached to the brick pedestal by means of adhesive and cement grout. Brick pedestals are expensive to build. Another solution used in marble shower stalls is the use of a natural marble slab cantilevered from a corner of the stall.

There are several problems associated with the use of natural marble cantilevered shower seats. Natural marble has veins of weaker stone which often cannot be detected by the naked eye. These veins can substantially weaken the slab, causing it to break. When natural marble breaks, it often breaks into sharp edges creating a safety hazard. Only carrara white marble has sufficient strength to be used in cantilevered shower seats.

Other colors in natural marble are not available because natural marble does not have sufficient strength for a cantilevered type of support. As such, unless the surrounding tile is also cut from carrara white marble, natural marble shower cantilevered seats do not match the surrounding tile. Thus, for any other color of marble, cantilevered seats are not aesthetically acceptable. As described above, colors can be matched if the seat is made of tile and supported by a structure formed out of brick or wood. These structures, however, are excessively expensive.

The need has arisen for an apparatus, therefore, when used as a shower seat in a shower stall lined with marble to be aesthetically acceptable by matching the color of the surrounding marble and to have the strength to safely support the weight of the human sitting on the seat with an acceptable factor of safety.

BRIEF SUMMARY OF THE INVENTION

According to the first embodiment of the principles of the present invention, a shower seat is provided comprising a single pour cultured marble slab whereby the slab is placed horizontally and is shaped such that four edges will fit into the corner of the walls of the shower stall. The principles of the present invention provide substantial advantages over the prior art. Among other things, these principles allow the slab to be aesthetically pleasing in appearance because the color of the slab is designed to match the surrounding marble tile, to contain sufficient strength so that it can be supported by the shower stall walls, to be durable and resistant to deterioration by water and soap, and to be economical to manufacture.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE INVENTION

Figure 1:
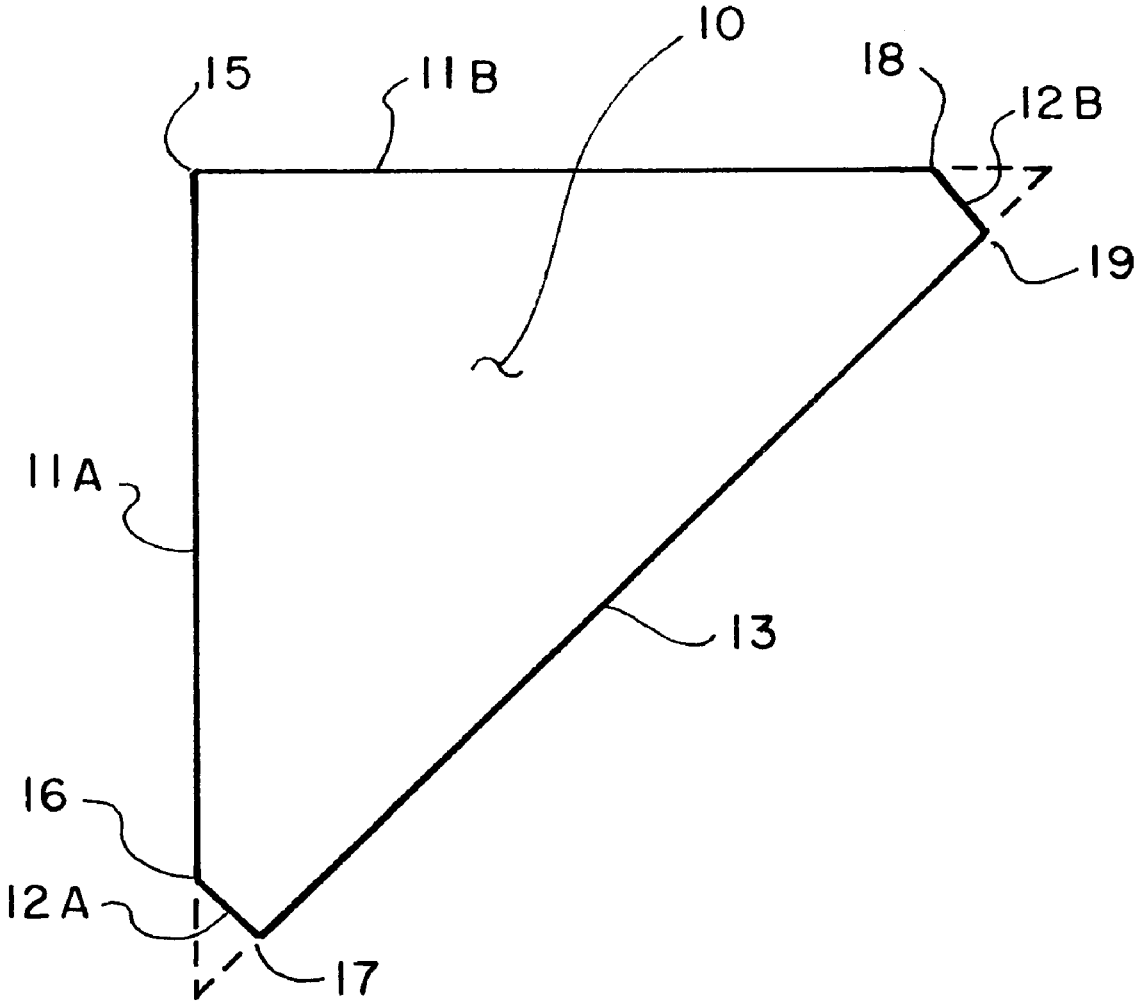
FIG. 1 is a top view of a shower seat according to the principles of the present invention.
Figure 2:
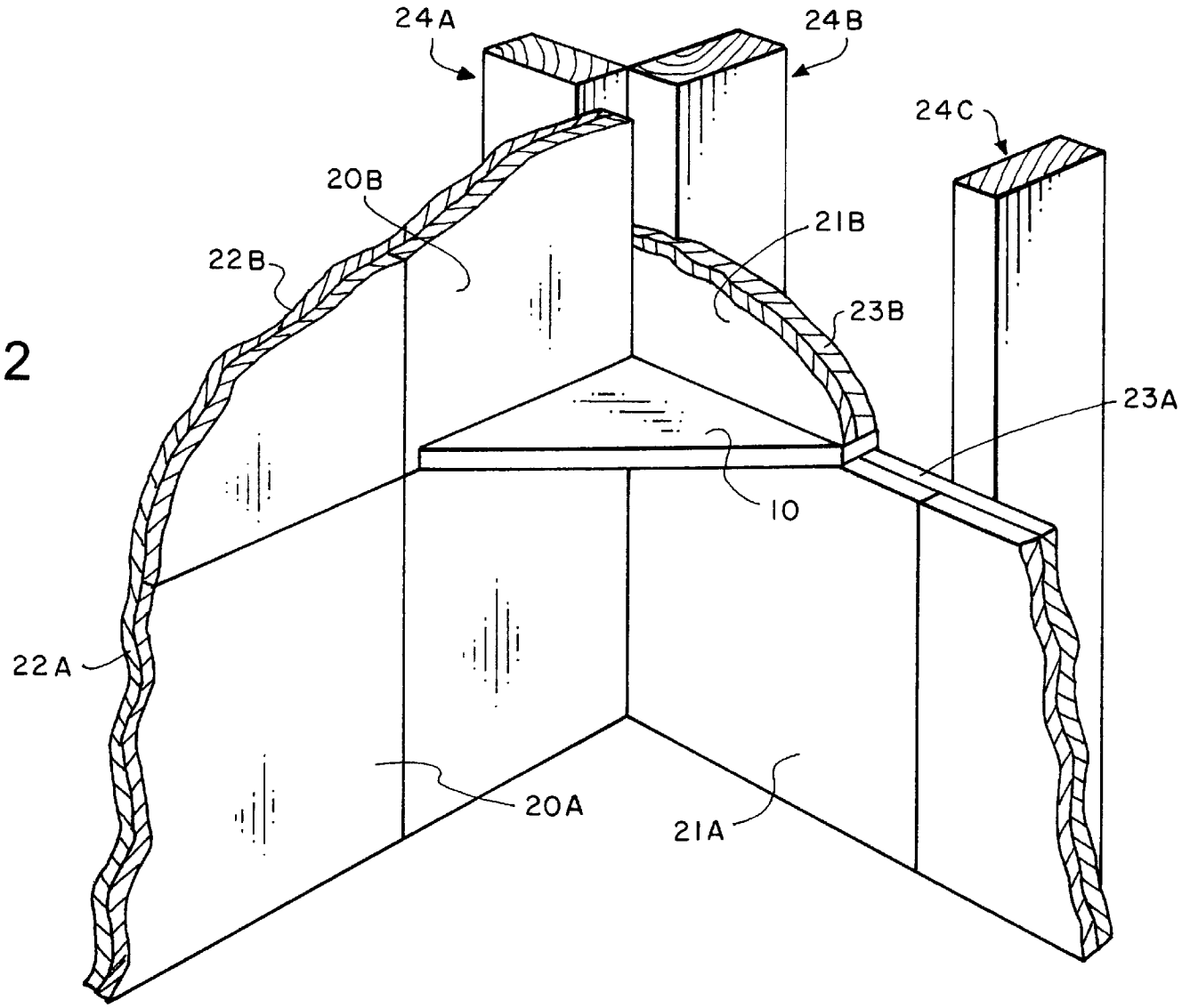
FIG. 2 is a perspective view of the shower seat of FIG. 1, showing a cutaway of a corner of a shower stall as viewed from the opposite corner of the shower stall, in combination with marble tile, concrete backboard, and wall studs.
Figure 3:
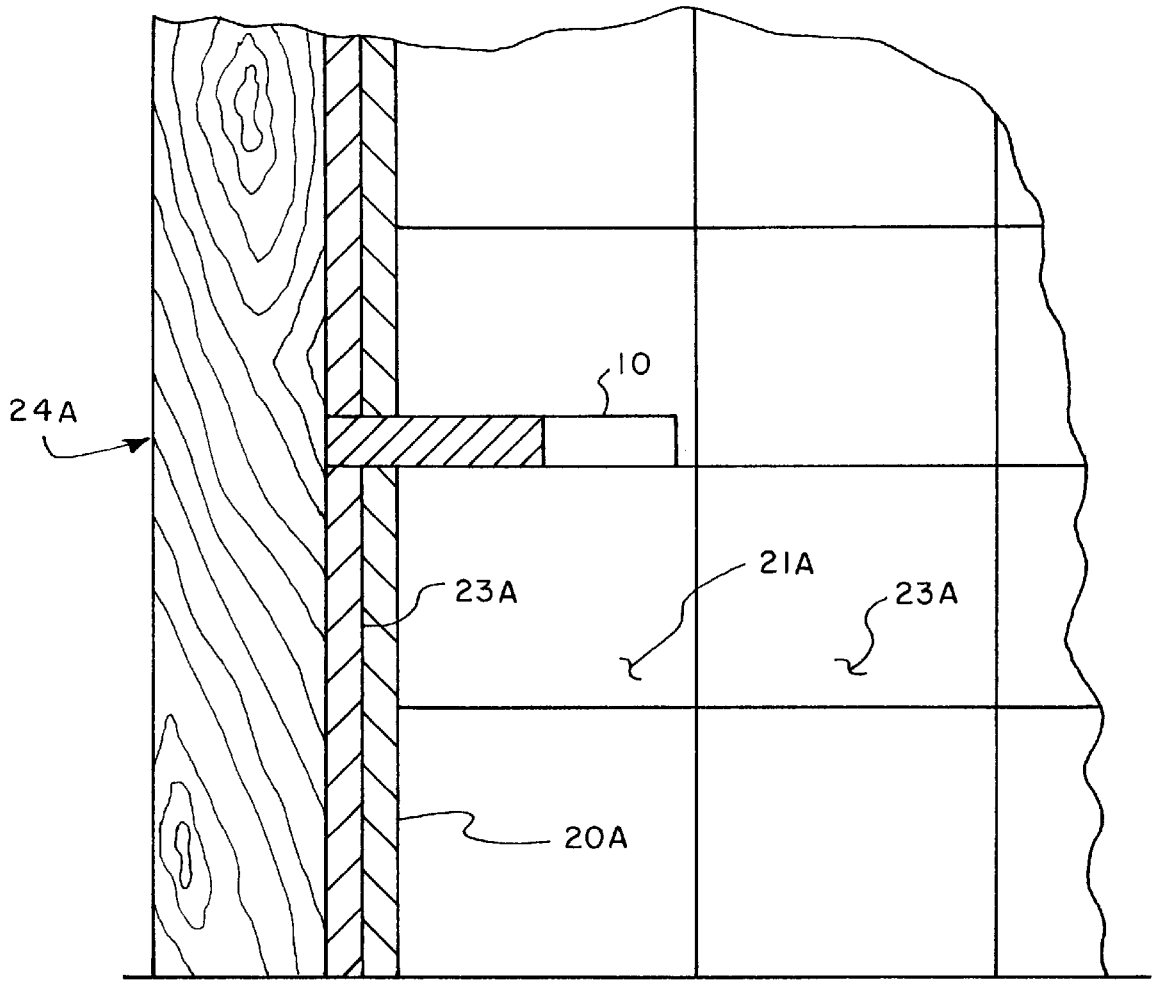
FIG. 3 is a cross sectional view of the shower seat of FIG. 2, installed in a corner of a shower stall, in combination with marble tile, concrete backboard, and the wall studs.

The principles of the present invention and their advantages are best understood by referring to the illustrated embodiment depicted in FIGS. 1 through 3 of the drawings, in which like numbers designate like parts. The disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

FIG. 1 is a top view of a typical embodiment of the present invention. The shower seat is a polygonal cultured marble slab 10 made from a single pour of cultured marble into a mold of a similar shape and having a thickness of at least ¾". The cultured marble compositions are well known in the cultured marble art. Typically, such compositions comprises from about 40 to about 60 parts by weight of a polyester casting resin, from about 80 to 120 parts by weight of a particulate material, a catalytic amount of a catalyst capable of cross-linking the polyester casting resin, and an effective minor amount of a pigment capable of providing the cured cultured marble composition with the color and texture capable of matching the surrounding marble tile.

Starting at reference point 15 on FIG. 1, Edge 11A is approximately 18" in length and forms approximately a 270° positive or 90° negative angle with the horizontal axis. At reference point 16, edge 11A forms an intersection with edge 12A such that edge 12A forms approximately a 315° positive or a 45° negative angle measured from the horizontal. Edge 12A is approximately 1½" in length. The length of edge 12A is approximately the thickness of the shower stall wall divided by the sine of 45° such that reference point 17 will be in the same vertical plane as the final inside face of the shower stall wall. At reference point 17, edge 12A forms an intersection with edge 13 such that edge 13 forms approximately a 45° positive angle with the horizontal.

Edge 11B is substantially identical in length to Edge 11A and is substantially parallel to the horizontal axis. At reference point 18, edge 11B forms an intersection with edge 12B such that edge 12B forms approximately a 315° positive or a 45° negative angle with the horizontal. Edge 12B is substantially identical in length to edge 12A. At reference point 19, edge 12B forms an intersection with edge 13.

FIG. 2 illustrates the connecting arrangement of a corner of a shower stall showing the present invention or the one-piece cultured marble slab 10 as a component of said stall. There is wall tile material 20A, 20B, 21A and 21B made of marble, ceramic, or some other suitable waterproof material. Directly behind and in contact with the tile material and in contact with said material, there is backboard material 22A, 22B, 23A and 23B which is plaster board, concrete board, or some other material of suitable construction. The tile material is attached to backboard material by means of adhesive grout and cement grout materials which are commercially available and well known in the art. The backboard material is attached to building materials commonly used in the construction industry such as 2"×4" studs 24A, 24B and 24C. At the desired vertical location slab 10, the backboard material is removed creating a corner opening or slot having a vertical dimension slightly larger than the thickness of slab 10 and a horizontal length slightly longer than edge 11A and 11B such that edge 11A and 11B can be slid into said slot. Edge 11A and 11B of slab 10 are then in contact with studs 24A and 24B. Slab 10 is positioned so that it is approximately horizontal and its bottom surface is supported by tile material 20A, 21A and backboard material 22A, 22B and 23B. Additional tile material 20B and 21B are then placed on the top surface of slab 10 and to the side of slab 10. All tiles or outer wall material are then grouted in place.

FIG. 3 is a cross-sectional view of connecting arrangement of a corner of a shower stall showing slab 10 as a component of said stall. Tile material 20A and 20B are attached to backboard material 22A and 22B which are attached to 2"×4" stud 24A with dry wall screws. Tile material 20A, 21A and backboard material 22A, 23A are shown supporting the bottom surface of slab 10. Tile material 20B, 21B and backboard material 22B, 23B are shown resting on and in contact with the top surface of slab 10. Such a connecting arrangement is secured by means of adhesive grout and cement grout materials which are commercially available and well known in the art. Thus, the slab is held in place vertically by these wall materials. The vertical constraints allow the slab to act similar to a cantilevered beam.

Cultured marble slab 10 has several substantial advantages over the prior art. Among other features, slab 10 has a more aesthetically pleasing appearance than the prior art because slab 10 can match the color of the tile used as outer wall material. Slab 10 can safely support a human relying only on conventional shower stall wall materials, eliminating the need to construct a brick or wood pedestal. Because the need for additional support is eliminated, slab 10 can be installed faster and at less cost than the prior art.

While the presently preferred embodiment of the invention has been described for purposes of this disclosure, the specificities contained in the description above should not be construed as limiting the scope of the invention. Numerous changes may be made by those skilled in the art and which are accomplished within the spirit of the invention disclosed and as defined in the appended claims. For example, the current embodiment of edge 13 is straight, however, edge 13 could also be curved; the use of the present embodiment is described as a shower seat, but at a higher vertical placement, the invention could also be used as a shelf.

What is claimed is:

1. A shower stall seat assembly comprising:

a cultured marble slab made from a single pour in a substantially horizontal position;

a shower stall consisting of vertical wall studs attached to a backboard where a horizontal corner strip of backboard has been removed to form a slot at approximately the desired height for the shower seat;

tiles are attached to the backboard such that the top of the top row of tile is at the bottom level of said corner slot;

a portion of said marble slab is then inserted into said corner slot such that the edges are against the structural supporting studs and said slab rests on the tile and the backboard; and tiles are then attached to backboard around and on top of said marble slab and grouted in place.

2. The assembly of claim 1 wherein said tiles of said shower stall comprise a surface covering of waterproof material having a preselected color, a color of said slab matching said color of said waterproof material.

3. The assembly of claim 1 wherein said tiles comprises ceramic tiles.

4. The assembly of claim 1 wherein said surface covering comprises marble.

5. The assembly of claim 4 wherein said marble comprises natural marble.

* * * * *